United States Patent [19]

Carbone

[11] 4,078,772

[45] Mar. 14, 1978

[54] STOCKADE FENCE FIXTURE THEREFOR

[76] Inventor: Michael Carbone, 2883 Miles Ave., Bronx, N.Y. 10465

[21] Appl. No.: 657,546

[22] Filed: Feb. 12, 1976

[51] Int. Cl.[2] ..... E04H 17/16

[52] U.S. Cl. ..... 256/24; 256/65; 256/68

[58] Field of Search ..... 256/21, 22, 27, 59, 256/65, 24, 73, 47, 32, 31, 68; 403/385, 171, 400, 389, 172, 176

[56] References Cited

U.S. PATENT DOCUMENTS

| | | | |
|---|---|---|---|
| 379,706 | 3/1888 | Landis | 256/24 |
| 1,315,351 | 9/1919 | Stevenson | 403/400 |
| 1,678,879 | 7/1928 | Selah | 403/171 X |
| 2,863,642 | 12/1958 | Pagett | 256/22 |
| 3,045,976 | 7/1962 | Nayhouse et al. | 256/73 X |
| 3,092,407 | 6/1963 | Blonder | 256/65 UX |

FOREIGN PATENT DOCUMENTS

| | | | |
|---|---|---|---|
| 18,723 of | 1899 | United Kingdom | 403/385 |

*Primary Examiner*—Andrew V. Kundrat
*Attorney, Agent, or Firm*—Arthur T. Fattibene

[57] ABSTRACT

A stockade fence comprising a plurality of stockade fence panels which are supported on metallic post and associated cross bars which are readily secured at right angles by a fixture which includes a pair of angularly disposed C shaped clamps arranged to embrace and secure the horizontal cross bar to the vertical post in any adjusted position. The fence panels are supported on the cross bar by resting the fence rails thereon with fasteners securing the rails of the fence panel to the support cross bars.

11 Claims, 7 Drawing Figures

STOCKADE FENCE FIXTURE THEREFOR

PROBLEM AND PRIOR ART

Heretofore stockade type fences were supported on wooden poles which were set into the ground. To support such fences, the wooden support post were required to be relatively large in diameter. Such poles were also required to be set into dug holes. Because of the relatively large wooden posts diameters, post holes were generally required to be dug by hand, as drilling equipment for such large size post diameters was quite expensive. As a result the digging of post holes for wooden poles was costly, tedious and time consuming. Such wooden posts in time also would tend to rot, even when such posts had been treated. Also the wind forces acting on the relative large areas of the stockade fence imposed large forces on such wooden support posts. Frequently, even a mild wind storm could cause considerable damage to such fences. The wind damage to such fences was further aggravated in the event the wooden support posts have been deteriorated as by rot, pests, and the like.

While efforts have been made to obviate these problems by utilizing metal pipes as the support members for the stockade fence panels, some difficulty have been encountered in supporting a wooden stockade fence panel to a metal support. The fixtures hereto used in supporting the metal supports were of the type which prohibits the finished fence to have a smooth or straight, uninterrupted appearance. Also the fixtures heretofore used were relatively difficult to apply and complicated the erection of such stockade fences.

OBJECTS

It is therefore an object of this invention to provide a stockade fence construction which is sturdy, relatively simple to erect and which is positive in operation.

Another object is to provide an improved fixture for horizontally supporting a metal cross bar to a vertical support post.

Another object is to support the panels of a stockade fence to a rigid support frame in a manner such that a smooth, even, fine plane is achieved.

BRIEF SUMMARY OF INVENTION

The foregoing objects and other features of this invention are attained by supporting the panels of a stockade fence on a rigid supporting members comprising of upright metallic fence posts and interconnected cross bars. The cross bars are adjustably positioned between the upright support posts by a fixture which comprises a pair of connected clamping members disposed at substantially right angles to one another. One clamp circumscribes the upright post and the other disposed at right angles thereto circumscribes the horizontal or cross bar extending between adjacent upright posts. The stockade panels are supported on the rigid supports by resting the cross rails of the fence panels onto the horizontal cross bars, and fasteners are utilized to secure the panels in place to the cross bars of the fence support.

FEATURES

A feature of this invention resides in the provision of an improved fence fixture which facilitates the erection of a stockade type fence.

Another feature resides in the provision of an improved fence fixture which permits a stockade fence to be erected with an entirely smooth and uninterrupted fence line.

Another feature resides in an improved fence fixture which enables a stockade fence to be rigidly supported so as to withstand the wind resistances imposed thereon.

Another feature resides in an improved fence fixture which is relatively simple in construction and can be inexpensively fabricated and which is easy to use.

Other features and advantages will become more readily apparent when considered in view of the drawings and specification in which.

DETAILED DESCRIPTION

Figure 2:
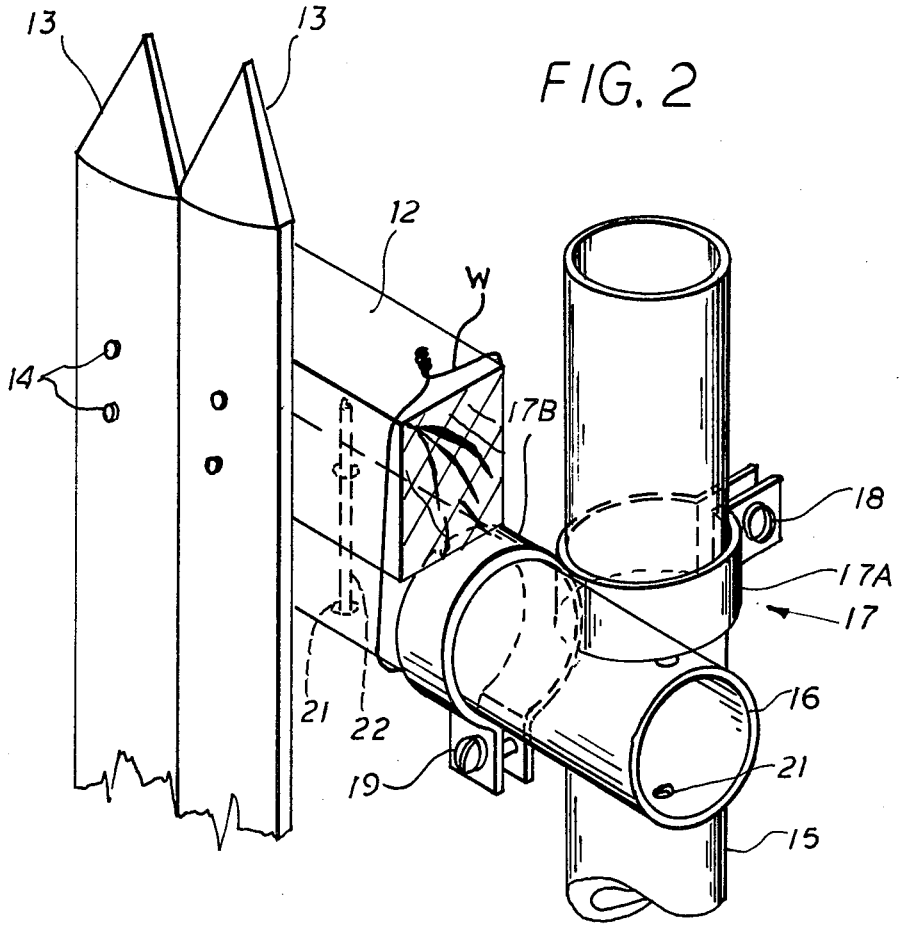
FIG. 2 is an enlarged perspective view of a fence fixture embodying the invention.
Figure 1:
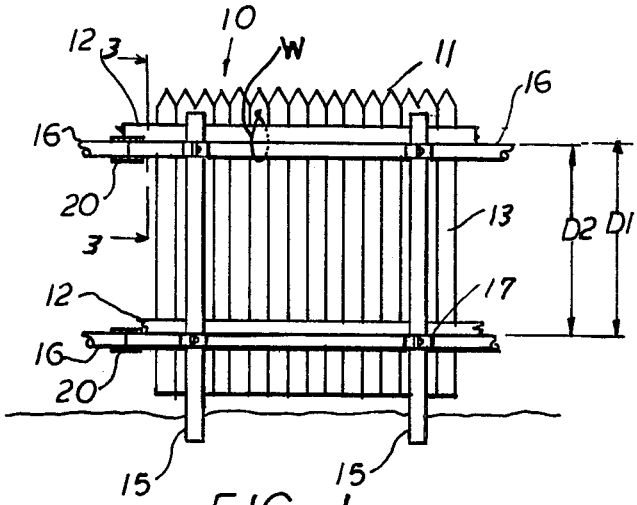
FIG. 1 is a front back elevation view of a stockade fence embodying the present invention.

Referring to the drawings, there is shown in FIG. 1 a stockade type fence 10 embodying the invention. Stockade fences comprise generally prefabricated fence panels 11 which may be 8 to 10 feet in length. However, it will be understood that the panel sections may vary in length and/or height. The panel sections comprise at least two vertically cross rails 12—12 to which the vertical picket or boards 13 are secured. The pickets or boards 13 are generally closely spaced to provide the stockade appearance. Suitable fasteners such as nails 14 secure the pickets 13 to the cross rails. As shown in FIG. 2 the cross rail 12 comprises a wooden beam such as a 2 × 4 or 2 × 3 or the like.

Because such stockade panels 11 are subjected to considerable wind resistance, a metal support structure is provided. As shown, the support structure or means for supporting the panel section to form a fence line comprises a series of spaced vertical support posts 15 interconnected by a series of cross bars 16. In the illustrated embodiment the posts 15 and connected cross-bars are formed of metallic pipe section, e.g., galvanized pipe and the like. Such pipe and cross bars have a diameter of 2 or 3 inches depending upon the size of the fence panels to be supported thereon.

Because the pipe posts 15 are relatively smaller in diameter than a wooden post required to support the stockade fence 10, the time and effort to sink a vertical pipe post 15 into the ground is reduced to a minimum.

In accordance with this invention, after the vertical posts have been placed in the ground, and anchored, if necessary, by a cement base, the cross rails are fixed in place by a fence fixture 17.

Figure 3:
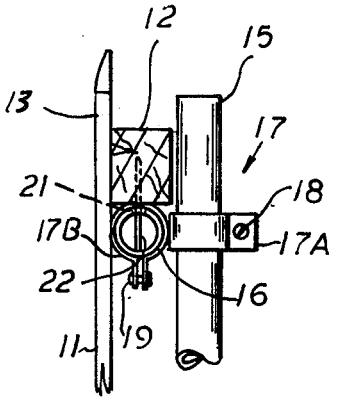
FIG. 3 is a side sectional view taken along line 3—3 on FIG. 1.

As best seen in FIGS. 2 and 3, the fence fixture comprises two connected clamps or loops 17A and 17B. Each clamp or loop 17A and 17B are similarly constructed and sized to accommodate the diameter of the post 15 and associated cross bar 16. In the illustrated embodiment, the clamps 17A is generally C shaped having its axis vertically disposed so as to embrace the post 15. The opposed ends of the clamp 17A are provided with aligned openings for receiving a bolt or fastener 18 by which the clamp 17A may be tightened or secured in place on posts 15.

Clamp 17B is fixedly or integrally formed to clamp 17A, so as to have its axis disposed substantially at right angle to the axis of clamp 17A. The arrangement is such that the cross bar 16 is received by clamp 17B. Claim 17B is frictionally secured to the cross bar 16 by tightening the associated bolt 19. With the fence fixture 17 described, it will be noted that the cross bars 16 can be readily assembled to the posts 15 and secured at the desired elevation in a simple and expedient manner simply by tightening the respective bolts 18 and 19.

In the assembly of the support means; the adjacent ends of the cross bars may be coupled together by a coupler sleeve 20, as best seen in FIG. 1. In this manner a continuous fence line can be established.

As best seen in FIG. 1 the respectively upper and lower cross bars 16—16 are supported to the respective posts 15 so that the distance $D_1$ between the upper edge of the cross bars is substantially equal to the distance $D_2$ between the bottom edge of the fence cross rails 12. By spacing the cross bars 16—16, the fence panel during errection can be supported on the support means 16, 16, simply by resting the bottom edge of the fence cross rails 12 on the top edge of the associated cross bar 16 as seen in FIGS. 1 and 2.

To secure the fence panels 11 in place to the metal support 15 and 16, the cross bar 16 may be formed with a series of spaced holes 21 formed therein at regular spaced intervals. By driving a nail 22 or other suitable fastener through the holes 21 and into the fence rail 12 supported thereon, a positive connection of fence panel to support structure is achieved.

In the construction described it will be apparent that the cross bar is sized so as to be slightly less than the width of the fence rail 12. In this manner the fence sections can be readily supported on the cross bars 16 so as to provide a uniform or smooth fence line to the assembled fence; as best seen in FIGS. 1 and 2.

Figure 4:
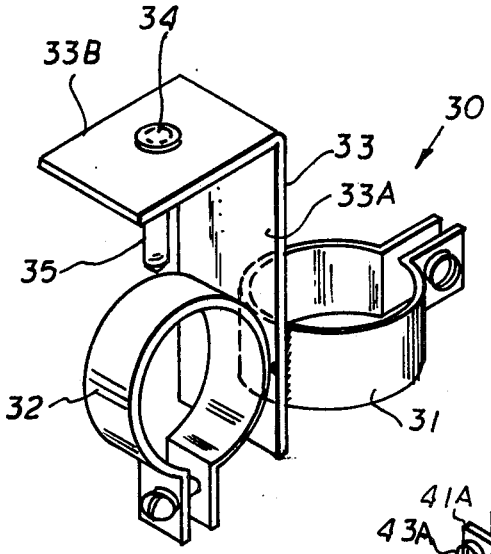
FIG. 4 is a modified construction of a fence fixture of this invention.
Figure 5:
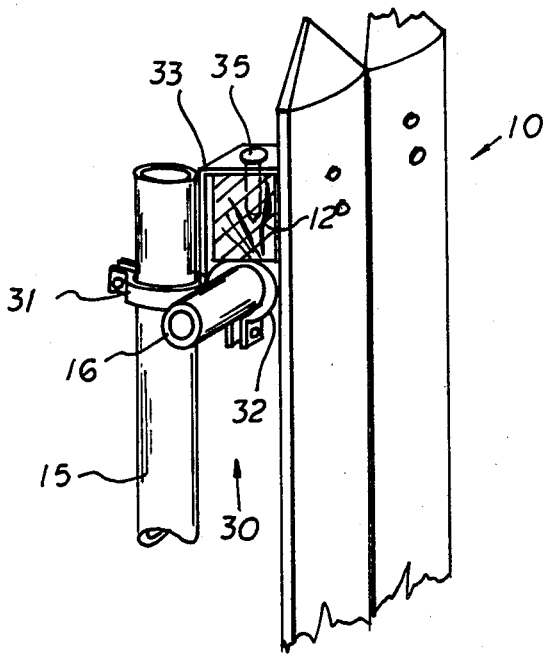
FIG. 5 is a detailed perspective view of a stockade fence construction utilizing the fixture of FIG. 4.

FIGS. 4 and 5 illustrate a modified embodiment of a fence fixture 30 for facilitating the errection of a stockade fence. In this form, the fixture 30 comprises a pair of clamps or loops 31 and 32 which are similar in construction and used as hereinbefore described with respect to FIG. 2. However, in this form, an angled bracket 33 is integrally formed or connected between clamps 31 and 32. As shown the bracket comprises a vertical leg portion 33A and a connected horizontal leg portion 33B extending over clamp 32. The spacing between clamp 32 and the horizontal leg portion 33B is such as to accommodate the fence rail 12 as best seen in FIG. 5.

As shown in FIG. 4, the leg portion 33B is formed with an aperture or hole 34. Hole 34 is provided for accommodating a nail or fastener 35 by which the rail 12 of fence 10 can be held in place to the support structure of the vertical posts 15 and cross bars 16, as seen in FIG. 5. In all other respects the construction of the fence of FIG. 5 is similar to that hereinbefore described.

With the construction described, the errection of a stockade fence is greatly expedited and which at the same time provides for a more sturdily erected fence capable of withstanding large wind resistance forces.

As shown in FIGS. 1 and 2 the cross rail 12 of the fence section or panel 11 may be secured to the support cross bar by tying, e.g., example with wire W. Thus the fence panel can be tied to the support cross bars 16 by wire and/or nailed thereto by nails 22.

Figure 6:
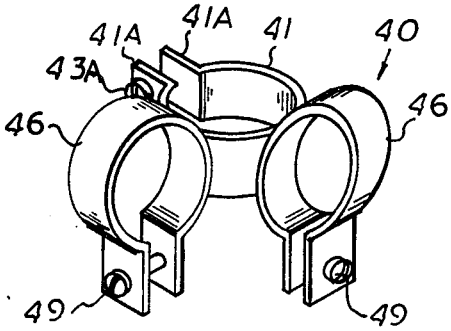
FIG. 6 is a perspective view of a modified embodiment.
Figure 7:
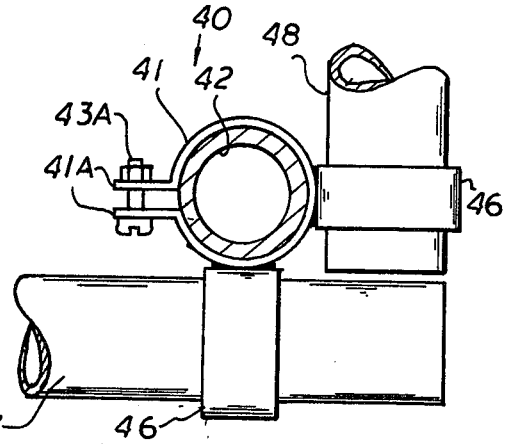
FIG. 7 is a plan of the fixture of FIG. 6 as applied to a corner post.

FIGS. 6 and 7 illustrate a modified fence fixture 40. Fixture 40 is particularly adapted for use at corners. As shown the fixture 40 comprises a post clamp 41 which has a vertical axis and which is sized to clamp into a verticle corner post 42. The opposed ends 41A–41A of the post clamp 41 has aligned openings 43 for receiving a bolt or other fastener 43A whereby the clamp 41 can be fixedly secured to a vertical fence post 42 at the desired elevation.

Connected to the clamp 41 at angularly spaced distance are a pair of clamps 45 and 46. Clamps 45 and 46 are similar in construction. They comprise C shaped clamps which are sized to embrace cross bars 47, 48 respectively, and which in the assembled position define a corner. In the illustrated embodiment the clamps 45 and 46 are disposed at substantially right angles to one another to define a 90° corner. However, it will be understood that clamps 45 and 46 can be disposed relative to one another at any desired angularly relationship depending upon the shape of the area to be fenced. Both clamps 45 and 46 are provided with bolt type fasteners 49 by which the respective clamps 45, 46 can be fixedly secured to the support cross bars 47, 48. As shown in FIG. 7, the free ends 41A–41A of the post clamp is aligned with one of the bar clamps, e.g., clamp 46.

With the support bars 42 and 47, 48 erected, the respective fence panels 11 can be supported and secured to the supporting bars in a manner similar to that hereinbefore described.

The fence fixtures 17, 30 and 40 are relatively simple in structure and can be readily fabricated. Also, the fixtures 17, 30 and 40 enables a supported stockade fence to be erected in a minimum of time. With the fixtures described, the support cross rails may assume any desired length. Thus, the time and effort heretofore required to make the support cross a specific length is eliminated. Also the fixtures enable the support bars to be more rigidly secured to one another. Thus the fixtures render the alignment of the support bars to be effected with greater ease and in less time. Also the fixtures enable the stockade fence in the erected position to be formed with an entirely smooth and uninterrupted surface.

While the present invention has been described with respect to several embodiments thereof, it will be appreciated and understood that variations and modifications may be made without departing from the spirit or scope of the invention.

What is claimed is:

1. A stockade fence comprising:

a stockade fence panel including at least a pair of spaced apart horizontal rails, and a plurality of stockade pickets connected to said spaced apart rails, a support means for supporting said fence panels, said support means including a plurality of vertical support posts located at spaced intervals along a fence line, at least a pair of spaced apart horizontal cross bars extended between adjacent pairs of said support posts, a fixture for securing each of said cross bars at substantially right angles to said support posts, said cross bars defining a support for said horizontal rails, and means for securing said horizontal rails to said cross bars.

2. The invention as defined in claim 1 wherein said posts and said cross-bars comprise metal pipe members.

3. The invention as defined in claim 2 wherein said fixtures comprise a first C shaped clamp adapted to circumscribe said posts and a second C shaped clamp adapted to circumscribe said cross bars, said first and second C shaped clamps being disposed at right angles, and means for integrally connecting said C shaped clamps together.

4. The invention as defined in claim 3 wherein said latter means comprises an angle member connected to said C shaped clamps, said angle member having a vertical leg disposed between said first and second C shaped clamps, and a horizontal leg adapted to extend across the horizontal rail of said fence panel, and a fastener for securing said horizontal leg of said angle member to said rail.

5. A fixture for securing a horizontal cross bar to a vertical support post disposed at substantially right angles to one another comprising:

a first C shaped clamp adapted to circumscribe a horizontal cross bar, a second C shaped clamp adapted to circumscribe a vertical post, said first and second C shaped clamps being disposed at right angles, means for integrally interconnecting said C shaped members, means for frictionally securing the respective C shaped clamps to the respective cross bar and vertical post, said clamps being formed of flat stock, and including an angled bracket connected to said integrally connected clamps, said angled bracket including a vertical leg extending above said C shaped clamps, and a horizontal leg extending over one of said clamp members.

6. The invention as defined in claim 5 wherein said horizontal leg extends over said first mentioned clamp.

7. The invention as defined in claim 6 and including a fastener for securing said cross rail between said clamps and said horizontal leg.

8. In combination, a stockade fence comprising:

a plurality of stockade fence panels, each of said fence panels including at least a pair of horizontal wooden cross rails and a plurality of vertical picket connected thereto, support means for supporting said fence panels in contiguous relationship, said support means including a plurality of support posts located at spaced intervals along a fence line, at least a pair of spaced apart cross bars extending between adjacent support posts at substantially right angles thereto, said posts and cross bars being formed of metal pipe, said support posts being disposed to one side of said cross bars, a fixture for securing said horizontal cross bars to said support posts, said fixture comprising a C shaped clamp having its axis extending along the longitudinal axis of said cross bars, and disposed to circumscribe said cross bars, a second C shaped clamp integrally connected to said first mentioned clamp, said second clamp having its axis extending along the longitudinal axis of said support posts and said second clamp circumscribing said support posts, a means for tightening said clamps to the cross bars and posts respectively, said fence panel being supported on said support means by the rails of said panel resting on the horizontal cross bars, and means for securing said fence rails to said horizontal cross bars.

9. The invention as defined in claim 8 wherein said latter means includes a fastener extending through said cross bar and into said fence rail.

10. The invention as defined in claim 8 wherein said last mentioned means includes a bracket connected to said clamps and extending upwardly therefrom, said bracket having a horizontally disposed leg portion adapted to overly said fence rail, and a fastener extended through said leg portion and into said fence rail to secure said fence rail to said support means.

11. A fixture for securing a horizontal support cross bar to a vertical support post disposed at substantially right angles to one another so as to define a rigid support for a stockade fence comprising:

a first C shaped clamp, said first C shaped clamp having a circumferential loop portion adapted to circumscribe a vertical bar, and said loop portion terminating in opposed end portions, said opposed end portions of said first C shaped clamp having aligned openings formed therein, said opposed end portions being oriented so as to be disposed opposite to said loop portion, a second C shaped clamp adapted to circumscribe a horizontal bar, said second C shaped clamp having a loop portion connected to and disposed at right angles relative to the loop portion of said first clamp, said second C shaped clamp being connected to a circumferential loop portion of said first C shaped clamp so as to be displaced 90° relative to the opposed end portion of said first clamp, the loop portion of said second clamp terminating in opposite end portions having aligned openings therein, said terminal end portions of said second clamp being disposed so as to project parallel to the axis of said loop portion of said first C shaped clamp and disposed at right angles to the end portions of said first clamp, said loop portion of said first C shaped clamp having an axis that is normally disposed relative to the axis of said second clamp, a third C shaped clamp having a loop portion connected to said first C shaped clamp and circumferentially spaced 90° from said second clamp adapted to circumscribe a horizontal cross bar, and said loop portion of said third clamp terminating in opposed end portions projecting in the same direction as the end portions of said second clamp.

* * * * *